United States Patent [19]

Lindberg, Jr.

[11] Patent Number: 4,716,987

[45] Date of Patent: Jan. 5, 1988

[54] SWIMMING POOL LADDER SECUREMENT DEVICE

[76] Inventor: Albert W. Lindberg, Jr., 125 W. 6th St., Bayonne, N.J. 07002

[21] Appl. No.: 39,308

[22] Filed: Apr. 16, 1987

Related U.S. Application Data

[63] Continuation-in-part of Ser. No. 891,482, Aug. 1, 1986, abandoned.

[51] Int. Cl.[4] ..... E06C 7/50; E06C 9/06

[52] U.S. Cl. ..... 182/97; 182/91; 403/227

[58] Field of Search ..... 182/97, 98, 106; 403/227; 411/177

[56] References Cited

U.S. PATENT DOCUMENTS

| | | | |
|---|---|---|---|
| 1,873,895 | 8/1932 | Kimbell | 411/177 |
| 2,102,558 | 12/1937 | Johnson | 411/177 |
| 2,307,080 | 1/1943 | Schaefer | 411/177 |

FOREIGN PATENT DOCUMENTS

| | | | |
|---|---|---|---|
| 971087 | 7/1975 | Canada | 411/177 |

*Primary Examiner*—Reinaldo P. Machado

*Attorney, Agent, or Firm*—Collard, Roe & Galgano

[57] ABSTRACT

There is provided an improved securement device for a swimming pool ladder having tubular ladder rails which is hingedly connected to an anchor mounted in the swimming pool deck which permits quick detachment and reattachment of the swimming pool ladder to the anchor. Each securement device includes a ferrule capping the end of the tubular ladder rail adjacent the pool deck which is hingedly connected to the respective anchor in the pool deck, an expandable locking mechanism coupled to the ferrule and extending into the tubular ladder rail having a resilient cylindrical member which expands radially upon being compressed into locking engagement with the inside wall of the tubular ladder rail.

6 Claims, 4 Drawing Figures

SWIMMING POOL LADDER SECUREMENT DEVICE

This is a continuation-in-part of my previously filed application Ser. No. 891,482, filed Aug. 1, 1986, entitled "SWIMMING POOL LADDER SECUREMENT DEVICE" and now abandoned.

The present invention relates to a detachable swimming pool ladder and, more particularly, it relates to an improved swimming pool ladder securement device which permits easy and quick detachment of the ladder from the securement device and thus from the swimming pool.

Specialized ladders are necessary in swimming pools in order to permit easy ingress and egress from the pool for swimmers and bathers. However, such ladders, since they are positioned along the peripheral edges of the pool, are a hindrance during swimming meets or races. The races during swimming meets are commenced by the participants executing a racing dive into designated racing lanes from the peripheral edge of the pool. If a pool ladder is so positioned along the peripheral edge of the pool as to interfere with such a dive, then the corresponding swimming or racing lane cannot be used. In order to avoid such a situation, pool ladders are often positioned along the perimeter of a pool outside of the racing areas thereby limiting their availability to bathers who utilize the pool other than during racing events. Otherwise, it is necessary to unbolt the ladders from the pool deck and wall in order to accommodate each racing event. If this latter course is followed, a great deal of time and effort must be expended by the pool maintenance personnel in order to accommodate each racing event.

Many pool ladders in use today utilize a hinged securement to the pool deck which permits the ladder to be pivoted out of the pool. With such a hinged construction, the bottom ends of the ladder rails are not fastened to the pool sidewall thereby permitting the upward swinging movement of the ladder. Such hinged pool ladders permit easy covering of the pool during the off season, and also allow for easier cleaning of the pool. Nevertheless, these hinged pool ladders still interfere with the conduct of racing events and the ladders must be taken into consideration during the preparation for such events.

It should also be noted that any means utilized for the quick detachment of a pool ladder from the pool deck must also incorporate a design which utilizes a minimum of exposed or protruding parts. Since such a device would be located at or near the pool deck surface, barefooted bathers would be prone to feet and toe injuries resulting from inadvertent collisions with any exposed parts.

In my previous U.S. Pat. No. 4,552,245, granted Nov. 12, 1985, I disclose a securement means for a pool ladder which permits the quick detachment of the pool ladder from the pool deck. The securement means disclosed in my previous patent includes a ladder rail ferrule for each ladder rail hingedly connected to the anchor mounted in the pool deck and girdling the end of the tubular ladder rail, and means releasably securing the tubular ladder rail to the ladder rail ferrule. The releasable securement means comprises an internally expandable split ring disposed within the ladder rail which is engaged by the tapered sidewall of a conically-shaped ring expander whose tapered sidewall faces the closed end of the ferrule and whose diameter is slightly less than the inside diameter of the tubular ladder rail. The ring expander is threadably engaged to a clamping bolt which passes through the closed end of the ferrule. Thus, in order to secure the ladder rail to the ferrule, it is merely necessary to turn or screw the clamping bolt so that the ring expander threadably engaged therewith is moved toward the closed end of the ferrule so that the tapered sidewall which engages the split ring, which is prevented from moving axially by a cylindrical spacer disposed between it and the closed end of the ferrule, is expanded outwardly to lockingly engage against the inside of the tubular ladder rail. To quickly disengage the tubular ladder rail from the ferrule, it is merely necessary to back off or unscrew on the clamping bolt so as to relax the split ring which disengages from the inside wall of the tubular ladder rail.

It is an object of the present invention to provide an improvement over the swimming pool ladder securement device disclosed in my previous U.S. Pat. No. 4,552,245 which significantly simplifies the device and hence significantly reduces the cost thereof.

This object, as well as others which will hereinafter become apparent, is accomplished in accordance with the present invention, by providing a quick detachment means for the easy and quick detachment and reattachment of the tubular rails of a pool ladder to a pool ladder securement, wherein the quick detachment means comprises a ferrule which is hingedly connected to an anchor in the pool deck and which has a closed end. The tubular rail of the pool ladder fits into the sleeve of the ferrule and is releasably clamped therein by means of a clamping bolt which passes centrally and axially through the closed end of the ferrule and threadably engages with a substantially round or circular compression plate. An expandable rubber-like cylindrically shaped member is disposed between the compression plate and the end wall of the ferrule. In order to secure the tubular rail of the ladder within the sleeve of the ferrule, the clamping bolt is turned or screwed in so as to compress the tubular rubber-like element between the compression disc and the end wall of the ferrule and thus expand the rubber-like member radially forcefully against the inside wall of the tubular rail. A means may also be provided for preventing the compression disc from turning as the clamping bolt is turned.

Other objects and features of the present invention will become apparent from the following detailed description considered in connection with the accompanying drawings. It is to be understood, however, that the drawings are designed for the purpose of illustration only and not as a definition of the limits of the invention.

In the drawings, wherein similar reference characters denote similar elements throughout the several views.

Figure 1:
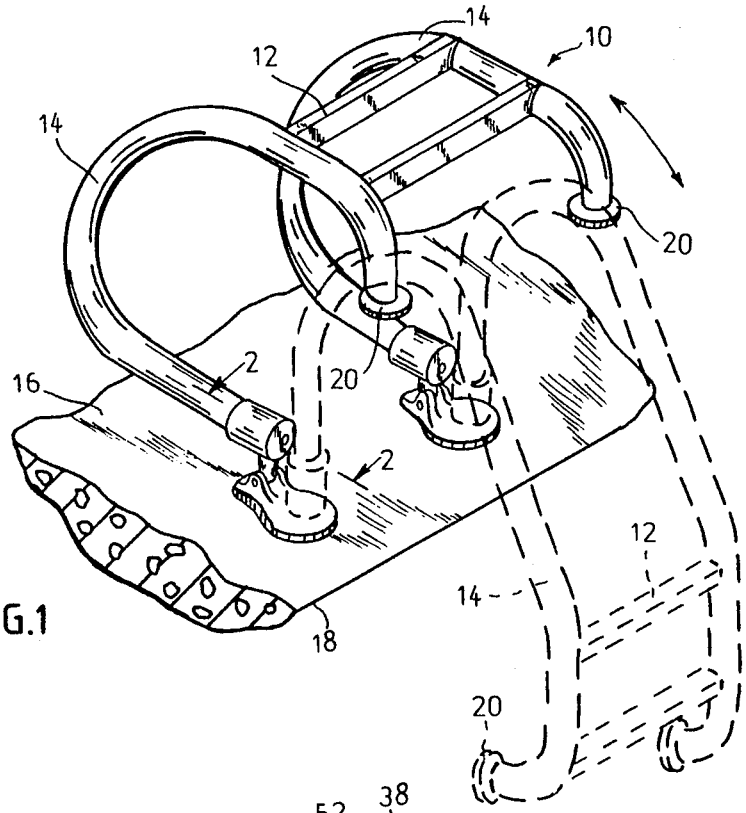
FIG. 1 is a perspective view of a swimming pool ladder secured to a pool deck in accordance with the present invention.

Now, turning to the drawings, there is shown in FIG. 1 a swimming pool ladder generally designated 10 having a plurality of rungs 12 interconnecting two identical tubular shaped ladder rails, designated 14. Ladder 10 is hingedly mounted to the horizontal surface of swimming pool deck 16 so that when in the position shown in phantom in FIG. 1, rungs 12 form vertical steps to permit a bather in the pool to climb the ladder by mounting the rungs and grasping ladder rails 14 to lift himself out of the pool. At their upper ends, ladder rails 14 are provided with a reverse curve so that they meet the horizontal surface of the pool deck 16 perpendicularly. The lower end of ladder rails 14 are turned inwardly toward the pool sidewall, designated 18, and are provided with bumpers 20 to abut the sidewall.

Figure 2:
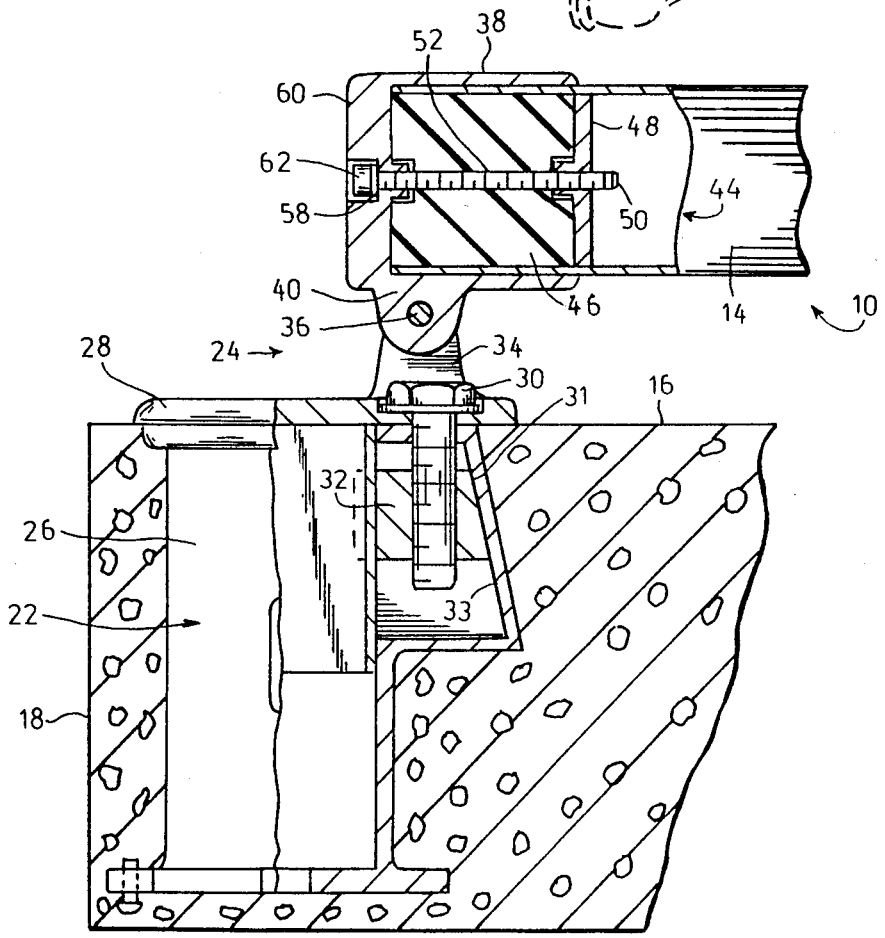
FIG. 2 is a cross-sectional view of the swimming pool ladder securement of FIG. 1 taken along line 2—2 of FIG. 1.

As clearly seen in FIG. 2, pool ladder 10 is pivotally or hingedly mounted to an anchor assembly, designated 22, by means of hinge 24. Anchor assembly 22 is comprised of an anchor socket 26 having an escutcheon plate 28 fastened to the top thereof by means of bolt 30 and threaded wedge fastener 32. As bolt 30 is turned, thus drawing wedge fastener 32 upwardly, the wedge face 31 thereof engages the wedge face 33 of anchor socket 26 to lock thereagainst and thereby fasten escutcheon plate 28 to anchor socket 26. Anchor socket 26 is positioned in pool deck 16 at the time the concrete for the deck is poured so that it is thereby embedded within the deck. Extending from escutcheon plate 28 are bearing supports 34 which support hinge pin 36 of hinge 24.

Figure 3:
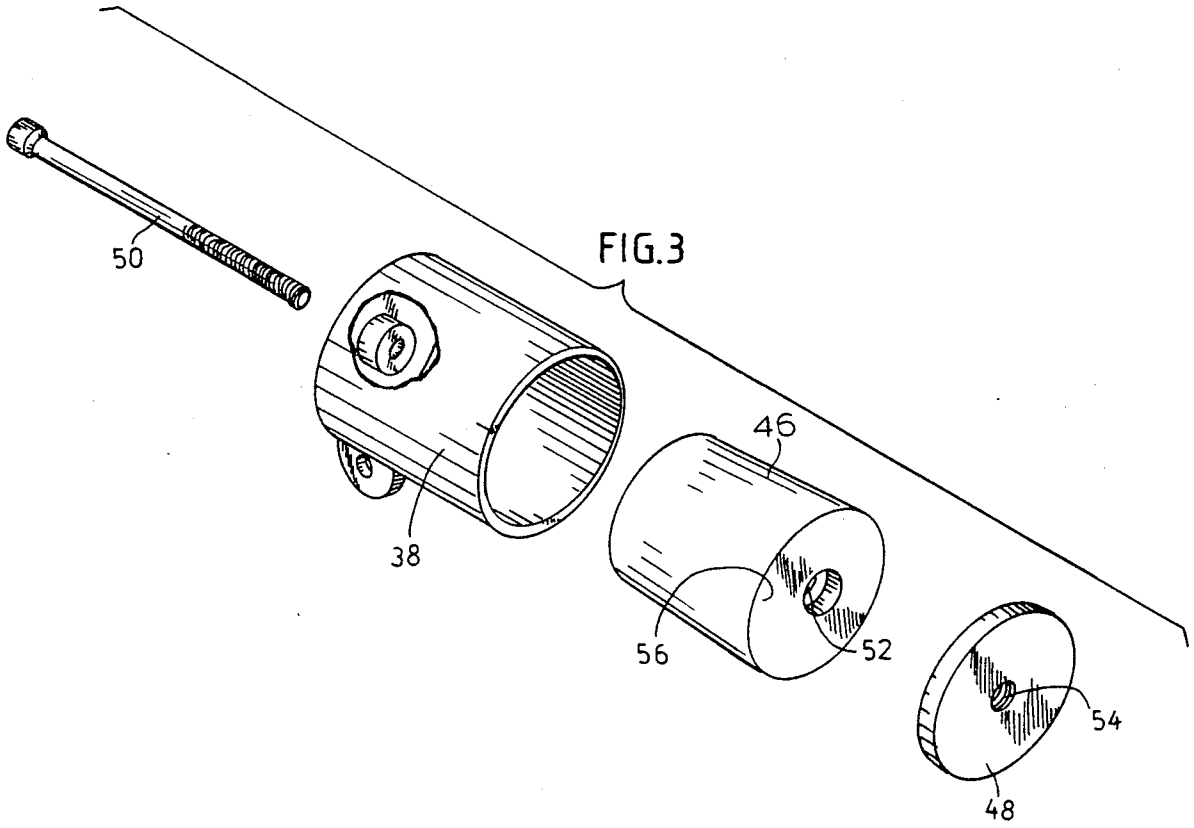
FIG. 3 is an exploded view of the securement means shown in FIG. 2.

Ladder rail 14 of ladder 10 is girdled at its end adjacent pool deck 16 by means of a ferrule, designated 38, which itself is provided with a bearing support 40 for hinge pin 36. Bearing support 40 of ferrule 38 is so positioned thereon to permit the flat end wall 60 of ferrule 38 to be supported by and rest against escutcheon plate 28 when the ladder is positioned for use as shown in phantom in FIG. 1. Ladder rail 14 is releasably coupled with ferrule 38 by means of a clamping mechanism, designated 44, which includes a cylindrically-shaped resilient member 46, a compression disc 48 and a clamping bolt 50. Resilient member 46 is essentially cylindrically shaped, as clearly seen in FIG. 3, with a diameter slightly less than the inside diameter of ladder rail 14 and positioned on the interior of ladder rail 14. Resilient member 46 is provided with an axial bore 52 through which passes clamping bolt 50. Compression disc 48 has a diameter slightly less than the inside diameter of ladder rail 14 and is also positioned on the interior of ladder rail 14. Compression disc 48 is threadably engaged at a central bore 54 with clamping bolt 50 and is arranged against face 56 of resilient member 46. Clamping bolt 50 passes through a central bore 58 of end wall 60 of ferrule 38. In this way, resilient member 46 is disposed between compression disc 48 and end wall 60 of ferrule 38 with clamping bolt 50 passing through central bore 52 thereof and threadably engaging compression disc 48. As clearly seen in FIG. 2, the head 62 of bolt 50 engages end wall 60 of ferrule 38 so that as bolt 50 is turned, so as to screw into compression disc 48, resilient member 46 is compressed between compression disc 48 and end wall 60 of ferrule 38 and, because of its resiliency, it expands radially against the inside wall of ladder rail 14 to thus lockingly engage therewith. When it is desired to disengage ladder rail 14 from ferrule 38, it is a simple matter of merely unscrewing bolt 50 thereby relaxing the radial pressure exerted by resilient member 46 against ladder rail 14 so that the ladder rail may be loosened and removed from ferrule 38.

It should be noted that clamping mechanism 44 is located entirely within ladder rail 14 and ferrule 38 so that there is no additional exposure to injuries by bathers by devices located or positioned on the exterior of the pool ladder components.

Figure 4:
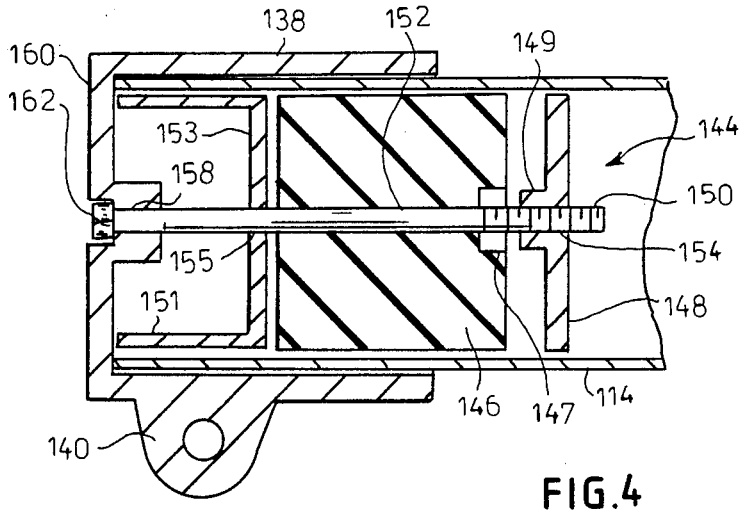
FIG. 4 is a cross-sectional view of another embodiment of the securement means.

In FIG. 4 there is shown another embodiment which includes a feature to prevent the compression disc, designated 148, from turning as clamping bolt 150 is threaded therein during assembly. As clearly seen, resilient member 146 is provided with an undercut 147 at bore 152 in the side of member 146 facing compression disc 148 which accommodates therein with a tight fit a bushing 149 surrounding bore 154 of the disc. A spacer 151 may also be disposed between the bottom face of resilient member 146 and the end wall 160 of ferrule 138. Spacer 151, at its side facing resilient member 146, is provided with an end wall 153 against which resilient member 146 is supported and a central bore 155. Thus, in assembling ladder rail 114 onto ferrule 138, the clamping mechanism 144 is first assembled by inserting bolt 150 through bore 158 in end wall 160 of ferrule 138, bore 155 in wall 153 of spacer 151, bore 152 in resilient member 146, and threadably engaging it with threaded bore 154 of disc 148. At this time bushing 149 is engaged in undercut 147 so that disc 148 is not permitted to turn. Clamping mechanism 144 is then inserted in ladder rail 114 and bolt 150 turned in disc 148, which itself is prevented from turning until resilient member 146 radially expands sufficiently to lockingly engage ladder rail 114 with ferrule 138.

While only a single embodiment of the present invention has been shown and described, it will be obvious that many changes and modifications may be made thereunto, without departing from the spirit and scope of the present invention.

What is claimed is:

1. A releasable securement device for a swimming pool ladder having a tubular ladder rail hingedly connected to an anchor mounted in the swimming pool deck, comprising:

a hollow cup-like cylindrical ferrule having an open end and a generally closed end, said ferrule conformed to slidably and coaxially receive the tubular ladder rail through the open end of said ferrule, the closed end having a hole therethrough located approximately coaxially to the longitudinal axis of said ferrule;

means for hingedly attaching said ferrule to the anchor;

clamping bolt means passing through said hole in the closed end of said ferrule and disposed generally coaxially with the longitudinal axis of said ferrule;

a cap shaped spacer with a central opening in the closed end thereof disposed within said ferrule so as to receive said clamping bolt means through said opening, said spacer being arranged so that the closed end thereof is spaced from the closed end of said ferrule;

a compression disc threadably engaged with said clamping bolt means, said compression disc being coaxially positioned within the tubular ladder rail to be secured and having a diameter slightly smaller than the inside diameter of the tubular ladder rail;

a cylindrically shaped resilient member with first and second ends and having an outside diameter in the relaxed state slightly smaller than the inside diameter of the ladder rail, said member being positioned within the ladder rail between said compression disc and the closed end of said spacer, so that when said bolt means is tightened, said copression disc retracts towards the closed end of said spacer, forcing the sidewall of the cylindrically shaped resilient member to expand radially outward to lockingly engage the inner surface of the ladder rail so as to prevent said member from moving within the rail; and means for releasably engaging said compression disc with the first end of said resilient member so that said disc does not turn during the threading of said bolt in said disc.

2. The securement device as defined in claim 1, wherein said means for hingedly attaching said ferrule to the anchor comprises:

an escutcheon plate;

at least two spaced apart plate bearing supports attached to said plate;

a ferrule bearing support connected to said ferrule and disposed between said plate bearing supports;

a hinge pin pivotally coupling said plate bearing supports to said ferrule bearing support; and an anchor bolt disposed between said plate bearing supports, said bolt passing through said plate and threadably engaging the anchor, thereby clamping said plate onto the anchor, said plate bearing supports and said ferrule bearing support therein preventing useful access to said bolt after said hinge pin is installed, thereby making a tamper-resistant attachment.

3. The securement device as defined in claim 1, wherein said hole in the closed end of said ferrule is counterbored, thereby preventing said clamping bolt from protruding beyond the bottom end of said ferrule.

4. The securement device as defined in claim 1, wherein said resilient member is formed of rubber.

5. The securement device as defined in claim 1, wherein the means for releasably engaging said compression disc with the first end of said resilient member comprises a bushing extending from said disc and a corresponding undercut in the first end of said resilient member which engages therewith.

6. The securement device as defined in claim 1, wherein said bushing and said undercut are coaxial with said disc and said resilient member, respectively.

* * * * *